US010233940B2

(12) United States Patent
Pohler

(10) Patent No.: US 10,233,940 B2
(45) Date of Patent: Mar. 19, 2019

(54) SHAFT SEALS AND LIQUID PUMP COMPRISING SAME

(71) Applicant: Liberty Pumps, Inc., Bergen, NY (US)

(72) Inventor: Donald M. Pohler, North Chili, NY (US)

(73) Assignee: Liberty Pumps, Inc., Bergen, NY (US)

( * ) Notice: Subject to any disclaimer, the term of this patent is extended or adjusted under 35 U.S.C. 154(b) by 685 days.

(21) Appl. No.: 14/920,143

(22) Filed: Oct. 22, 2015

(65) Prior Publication Data

US 2017/0114790 A1 Apr. 27, 2017

(51) Int. Cl.

| | |
|---|---|
| ***F04D 29/42*** | (2006.01) |
| ***F04D 13/06*** | (2006.01) |
| ***F04D 29/12*** | (2006.01) |
| ***F04D 29/58*** | (2006.01) |

(52) U.S. Cl.

CPC ..... *F04D 29/426* (2013.01); *F04D 13/06* (2013.01); *F04D 29/128* (2013.01); *F04D 29/5806* (2013.01)

(58) Field of Classification Search

CPC .... F04D 29/05; F04D 29/046; F04D 29/0473; F04D 29/049; F04D 29/426; F04D 29/605; F04D 29/628; F04D 1/00; F04D 13/0633; F04D 13/026; F04D 25/06; F04D 7/00; F04D 7/02; F04D 7/045; F04D 7/04

See application file for complete search history.

(56) References Cited

U.S. PATENT DOCUMENTS

| | | | | |
|---|---|---|---|---|
| 3,650,481 | A * | 3/1972 | Conery | B02C 18/0092 241/257.1 |
| 4,454,993 | A | 6/1984 | Shibata et al. | |
| 5,044,566 | A * | 9/1991 | Mitsch | F04D 7/045 241/259.3 |
| 5,122,032 | A | 6/1992 | Shields et al. | |
| 7,125,221 | B2 * | 10/2006 | Dorsch | F04D 7/045 415/121.1 |
| 7,159,806 | B1 | 1/2007 | Ritsema | |

(Continued)

OTHER PUBLICATIONS

Office Action in copending U.S. Appl. No. 13/739,041. EFS file name 20160310_14-920143_IDS_NPL_Cite1.pdf.

(Continued)

*Primary Examiner* — Woody A Lee, Jr.
*Assistant Examiner* — Aye S Htay
(74) *Attorney, Agent, or Firm* — John M. Hammond; Patent Innovations LLC

(57) ABSTRACT

A liquid pump including a motor housing, a motor, a volute housing joined to the motor housing, and upper and lower seals contained in the volute housing. The motor housing has a motor housing side wall including a distal end joined to the volute housing. The motor includes a rotatable shaft that extends into the volute housing. The volute housing includes an upper volute wall having a major portion in direct fluid communication with the motor housing volume, thereby enabling a high rate of heat transfer from the motor to the fluid in the volute that is being pumped. In that manner, the pump has dual seal capability that reduces the risk of motor damage due to a seal failure, while also having a high rate of heat transfer out of the motor housing, which reduces the risk of failure of the motor from operating at a high temperature.

16 Claims, 6 Drawing Sheets

(56) References Cited

U.S. PATENT DOCUMENTS

| | | | | |
|---|---|---|---|---|
| 7,168,915 | B2 * | 1/2007 | Doering | F04D 7/045 415/121.1 |
| 7,237,736 | B1 | 7/2007 | Martin | |
| 7,537,439 | B2 * | 5/2009 | Pohler | F04B 23/08 310/62 |
| 8,197,192 | B2 * | 6/2012 | Andersson | F04D 15/0033 415/121.1 |
| 2005/0053461 | A1 * | 3/2005 | Doering | F04D 7/045 415/121.1 |
| 2012/0207590 | A1 | 8/2012 | Pohler | |
| 2014/0199165 | A1 | 7/2014 | Pohler | |

OTHER PUBLICATIONS

Pentair Myers Model MRG20 Grinder Pump Installation and Service Manual, product document dated Nov. 8, 2012. EFS file name 20151122_14-920143_IDS_NPL_Cite1.pdf.

ABS "S" Series 2—4hp Piranha Grinder Pump product literature, product document pdf Created: Jul. 13, 2000. EFS file name 20151122_14-920143_IDS_NPL_Cite2.pdf.

Jung Pumpen G2DT/G2D-Series product literature, product document pdf Created: Dec. 7, 2010. EFS file name 20151122_14-920143_IDS_NPL_Cite3.pdf.

Office Action in U.S. Appl. No. 13/739,041 dated Jun. 1, 2015. EFS file name 20151122_14-920143_IDS_NPL_Cite4.pdf.

Myers Paentair Water SX50/SX50H Sump Pumps Installation and Service Manual, pdf Document Properties: Created Mar. 24, 2010. EFS file name 20151122_14-920143_IDS_NPL_Cite5.

* cited by examiner

SHAFT SEALS AND LIQUID PUMP COMPRISING SAME

BACKGROUND

Technical Field

This invention relates to liquid pumps, and in particular, the sealing of a liquid pump to prevent the liquid that is being pumped from coming in contact with the electric motor or other drive of the pump.

Description of Related Art

A pump typically is comprised of an electrical motor or other shaft driving mechanism mounted above a volute casing. The rotor shaft of the motor is connected to an impeller located in the volute casing. The electric motor rotates the impeller, which moves the liquid to be pumped. A housing surrounds the electrical motor, protecting it from moisture.

A major contributor to the cost of a pump is the electrical motor that drives the impeller. Protecting the electrical motor from moisture is very important and difficult to perform, because the motor shaft must extend beyond the motor enclosure and into the volute chamber, where it is connected to the impeller. During pumping of a liquid, the volute chamber is typically filled with pressurized liquid. Thus one or more seals must be provided on the motor shaft, which prevent the liquid being pumped from leaking along the shaft and into the motor housing where it would wet and damage the motor.

Historically, pump shafts have been sealed by the use of packing consisting of string, which has been soaked in tallow or similar grease, with a gland nut used to compress the packing into a stuffing box. Over the years "packing" has generally been replaced with mechanical face seals or lip seals. These newer devices have improved the seal ability but they are not without problems. A mechanical shaft seal can fail for a number of reasons. Solid debris such as sand can erode the sealing faces. Heat is another major source of seal failure. The sealing faces of a mechanical seal require lubrication to minimize the effects of friction. Installation of the seal and the alignment of the relative parts of the assembly also affect the life of a seal.

A seal failure is very costly. In the case of a single seal pump, only the volute wall separates the motor from the liquid being pumped, and thus the rate of heat transfer from the motor into the liquid is high. However, the risk of a seal failure and damage to the motor is also high, because failure of the seal results in direct contact of the motor with the liquid being pumped. Thus liquid entry into the motor enclosure can damage ball bearings, short the windings of the motor, and/or deteriorate the insulation of the motor. In some applications a seal failure could allow explosive liquid or gases to enter the motor enclosure and cause an explosion within the motor chamber. In these applications, an explosion proof pump is required.

For such applications in particular, pump manufactures offer dual seal pumps with a leak detection device located between the two seals. The benefit of this design is that the pump can be removed from service once the lower seal has been compromised. The liquid leak past the lower seal is detected before the liquid can leak past the upper seal and damage the motor. Normally the repair is simple, requiring only the replacement of the lower seal.

In providing dual seal pumps, pump manufacturers typically provide an enclosed cavity between the upper seal and the lower seal. This is done by adding an additional casting equal in diameter to the motor housing and located between the motor housing and the pump volute. The casting forms the enclosed cavity and also includes support for the upper and lower seals. The casting is also provided with a port and removable plug, so that the cavity can be filled with oil, so as to provide lubrication of the seals, and a better medium for detection of any leakage of liquid being pumped into the cavity.

However, the addition of the second seal and the oil-filled cavity has caused some difficulties with regard to cooling the electric motor of the pump. The electric motor that is used to drive the impeller of a pump creates a large amount of heat, which must be dissipated to the surrounding environment, which is either air, or for a submersible pump, water or another liquid. Some of the heat is dissipated out through the side wall of the motor casing. However, it is also highly beneficial to have a large amount of heat dissipated out through the bottom end of the motor through the volute wall, and into the liquid being pumped.

In current dual seal pumps having upper and lower seals, and an oil-filled cavity formed in a casting between the seals, the oil filled cavity is typically an annular cavity that occupies the entire volume between the motor shaft and the outer wall of the cavity and seal casting, and extends a full 360 degrees around the motor shaft. Thus the oil in the cavity acts as an insulating medium that reduces the rate of heat transfer from the pump motor axially through the upper pump volute wall and into the liquid being pumped through the pump volute. This reduced rate of heat transfer from the pump motor causes a problem in that due to sustained operation at higher temperatures, the life of the motor is reduced.

Thus there remains a need for a pump that has dual seal capability that reduces the risk of motor damage due to a seal failure, while also having a high rate of heat transfer out of the pump motor enclosure that reduces the risk of early motor failure from operating at a high temperature.

SUMMARY

In accordance with the present disclosure, in a liquid pump, the problem of protecting the pump motor from damage due to a seal failure, while also providing high heat transfer from the pump motor in order to extend its life is solved by providing dual seals and a cavity containing oil between them, but configuring the cavity such that it only occupies a relatively small portion of the volume between the pump motor and the pump volute, while still providing lubrication to the upper shaft seal of the pump. In that manner, the seals are provided with lubrication, the motor is isolated from the liquid being pumped even in the event of a lower seal failure, and a high rate of heat transfer from the motor is provided, thereby extending motor life.

More specifically, in accordance with the present disclosure, a liquid pump is provided, comprising a motor housing, a motor contained within the motor housing, a volute housing joined to the distal end of the motor housing, and upper and lower seals contained in the volute housing. The motor housing encloses a motor housing volume and is comprised of a motor housing side wall including the distal end that is joined to the volute housing. The motor is comprised of a rotatable shaft having a distal portion extending into the volute housing.

The volute housing is comprised of an upper volute wall comprised of a major portion and a minor portion, a seal housing, and a lateral cavity. The seal housing is comprised of a seal housing side wall surrounding the distal portion of the shaft of the motor, thereby forming an annular central cavity around the distal portion of the shaft of the motor, and including a lower end joined to the upper volute wall and comprising a lower bore, and an upper end including an upper bore. The lateral cavity is bounded by the minor portion of the upper volute wall, an upper cavity wall, and a side cavity wall joined to the seal housing side wall. The lateral cavity is in fluid communication with the annular central cavity through an opening in the seal housing side wall.

The upper seal is disposed in the upper bore, and is in sealing contact with the distal portion of the motor shaft, and in fluid communication with the annular central cavity. The lower seal is disposed in the lower bore and is in sealing contact with the distal portion of the motor shaft. The major portion of the upper volute wall is in direct fluid communication with the motor housing volume, thereby enabling a high rate of heat transfer from the motor to the fluid contained in the volute and being pumped.

In certain embodiments, the volute housing and seal housing may be formed cast as a single unitary part. The pump may be further comprised of an extended flange provided at the motor housing/volute housing interfaces.

In certain embodiments, the pump may be further comprised of a first bushing fitted in one of the lower bore and upper bore of the volute housing and comprising an outer surface contiguous with an inner surface of the one of lower bore and upper bore of the volute housing to form a first pressure-relieving interface therebetween. In certain embodiments, the first bushing may be comprised of an inner bore, wherein the lower seal is fitted therein, and wherein an outer surface of the first bushing is contiguous with an inner surface of the volute housing to form the pressure-relieving interface therebetween. In certain such embodiments, the pressure-relieving interface may be comprised of a horizontal interface formed between a horizontal surface of the first bushing in contact with a horizontal surface of the volute housing and a vertical interface formed between a vertical surface of the bushing in contact with a vertical surface of the volute housing. The vertical surface of the first bushing may be in contact with the vertical surface of the volute housing in a slip fit.

In other embodiments, the first bushing may be fitted in the upper bore of the volute housing. In such embodiments, the first bushing may be comprised of an inner bore, wherein an outer surface of the first bushing is contiguous with an inner surface of the volute housing to form the first pressure-relieving interface therebetween.

The pump may be further comprised of a second pressure-relieving interface formed by an inner bore of the first bushing that is contiguous with a portion of the rotatable shaft of the motor. The second pressure-relieving interface may be formed by an inner bore of a second bushing fitted in a cavity of the first bushing.

BRIEF DESCRIPTION OF THE DRAWINGS

The present disclosure will be provided with reference to the following drawings, in which like numerals refer to like elements, and in which.

Figure 1:
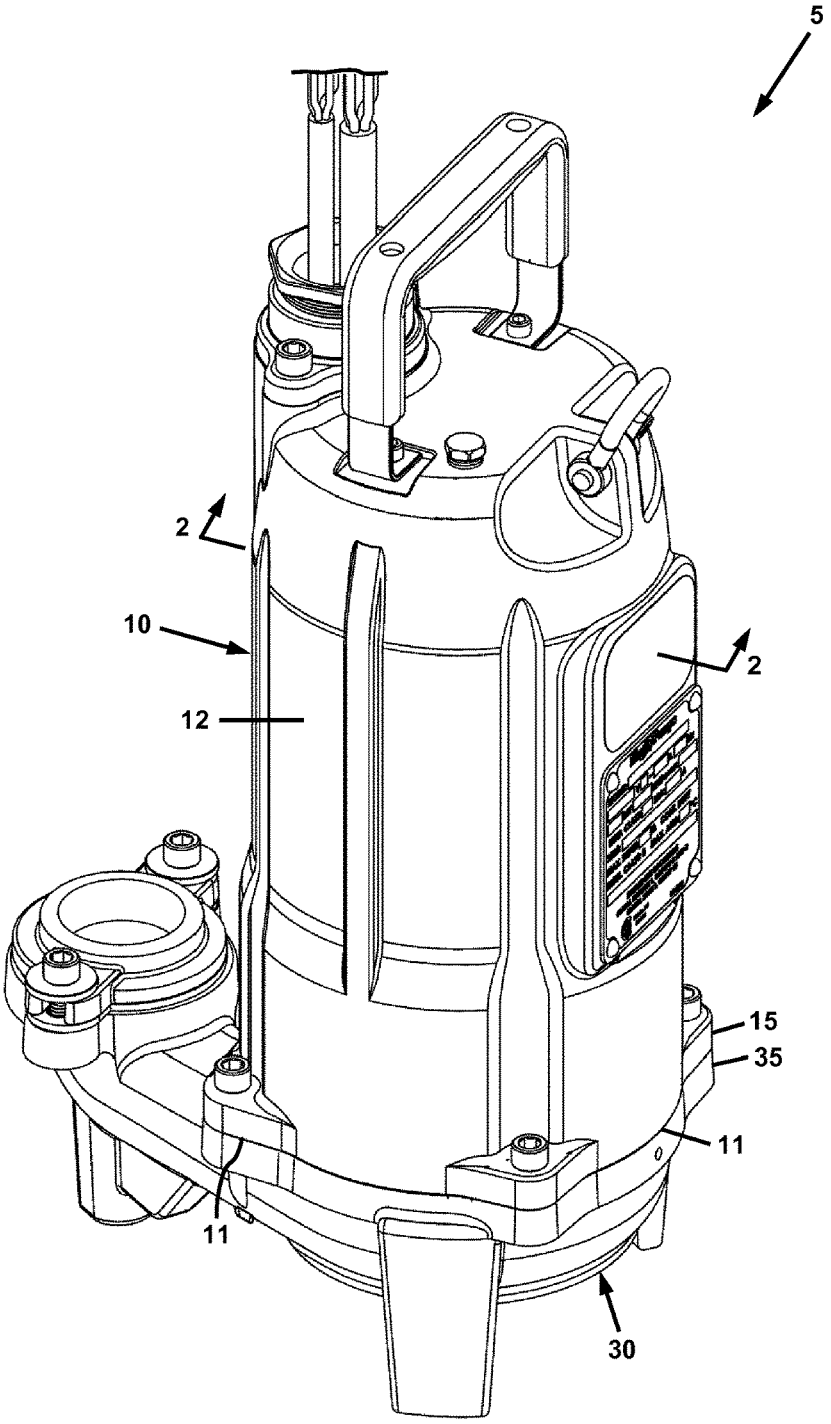
FIG. 1 is a pump in accordance with the present disclosure.

The present invention will be described in connection with certain preferred embodiments. However, it is to be understood that there is no intent to limit the invention to the embodiments described. On the contrary, the intent is to cover all alternatives, modifications, and equivalents as may be included within the spirit and scope of the invention as defined by the appended claims.

DETAILED DESCRIPTION

For a general understanding of the present invention, reference is made to the drawings. In the drawings, like reference numerals have been used throughout to designate identical elements. The drawings are to be considered exemplary, and are for purposes of illustration only. The dimensions, positions, order and relative sizes reflected in the drawings attached hereto may vary.

In the following disclosure, the present invention is described in the context of its use as a shaft seal for a pump. However, it is not to be construed as being limited only to use in sealing applications in pumps comprising a liquid mover driven by a rotating shaft. The invention is adaptable to any use in which sealing of a rotating shaft is desirable to be provided from a seal assembly comprising first and second seals disposed on the shaft at separate axial locations. Additionally, this disclosure may identify certain components with the adjectives "top," "upper," "bottom," "lower," "left," "right," etc. These adjectives are provided in the context of use of the orientation of the drawings, which is arbitrary. The description is not to be construed as limiting the shaft sealing assembly to use in a particular spatial orientation. The instant shaft sealing assembly may be used in orientations other than those shown and described herein. It is also to be understood that any connection references used herein (e.g., attached, coupled, connected, and joined) are to be construed broadly and may include intermediate members between a collection of elements and relative movement between elements unless otherwise indicated. As such, connection references do not necessarily imply that two elements are directly connected and in fixed relation to each other.

Figure 2:
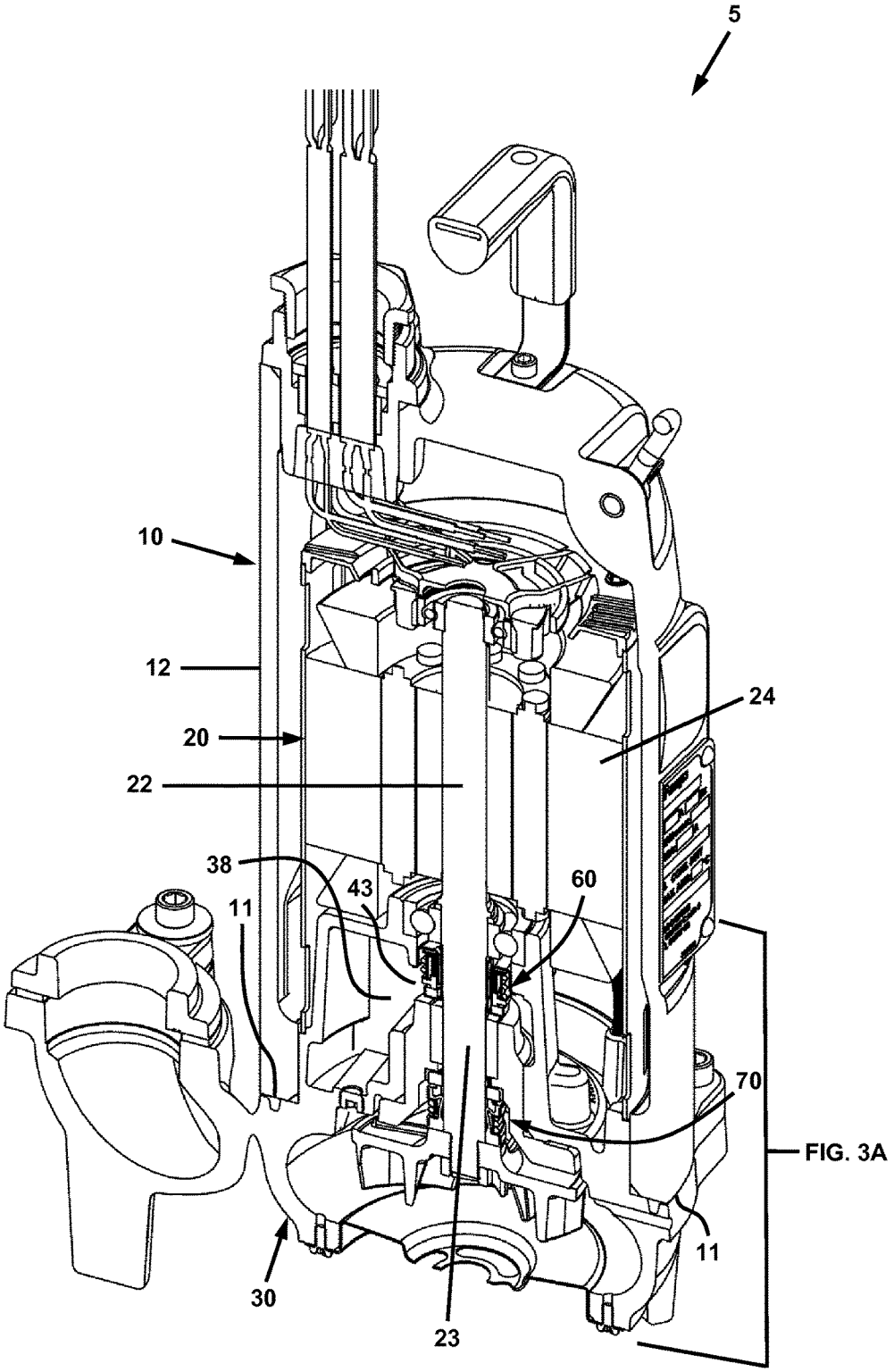
FIG. 2 is a perspective cross-sectional view of the pump of FIG. 1, taken along the line 2-2 of FIG. 1.

Referring first to FIGS. 1 and 2, a liquid pump 5 is depicted, comprising a motor housing 10, a motor 20 contained within the motor housing 10, and a volute housing 30 joined to the distal end 11 of the motor housing 10. Upper and lower seals 60 and 70 are contained in the volute housing 30. The motor housing 10 encloses a motor housing volume and is comprised of a motor housing side wall 12 including the distal end 11 that is joined to the volute housing 30. The motor 20 is comprised of a rotatable shaft 22 having a distal portion 23 extending beyond a motor stator 24 and into the volute housing 30. An impeller 25 is joined to the end of the distal portion 23 of the rotatable shaft 22.

Figure 3A:
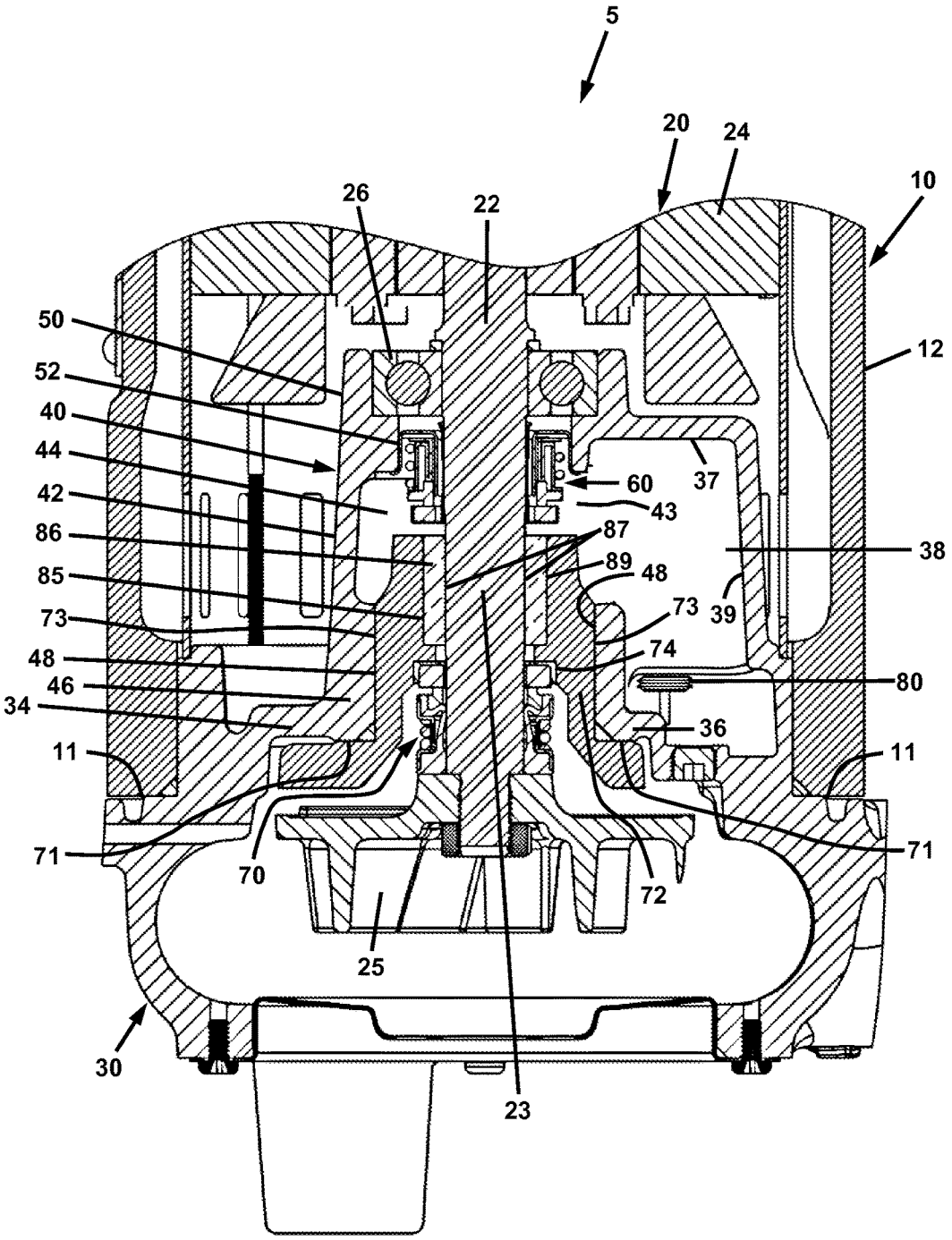
FIG. 3A is detailed side elevation cross-sectional view of the volute and lower motor region of a first embodiment of the pump, as denoted by the bracketed region marked "FIG. 3A" in FIG. 2.
Figure 4:
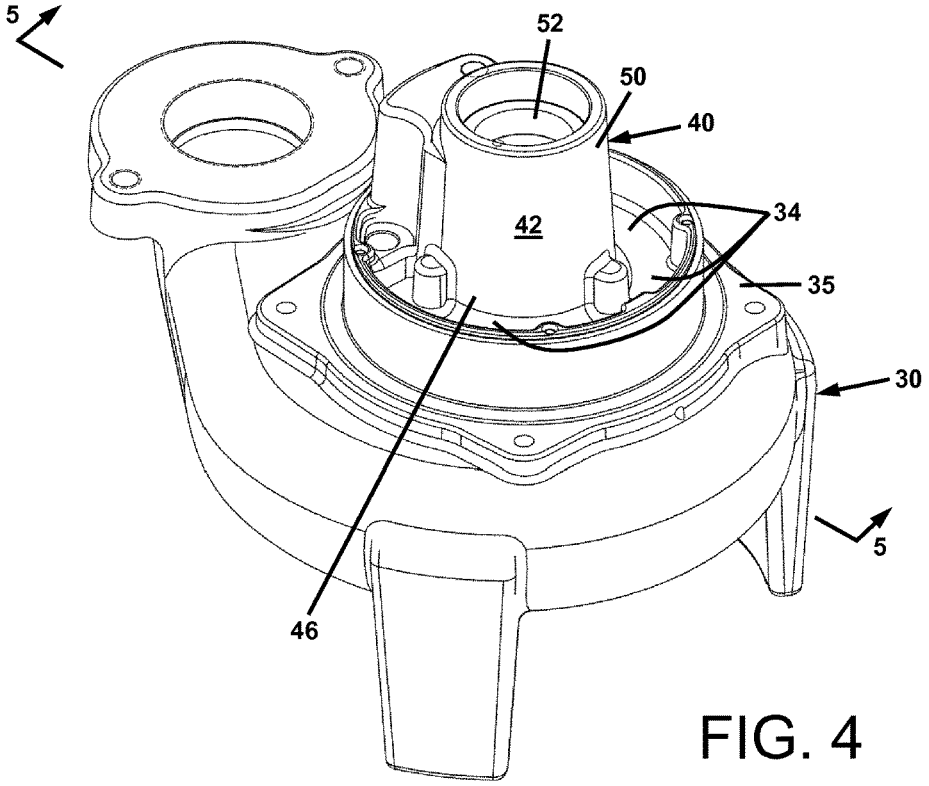
FIG. 4 is a perspective view of the volute and shaft sealing piece of the pump of FIG. 1.
Figure 5:
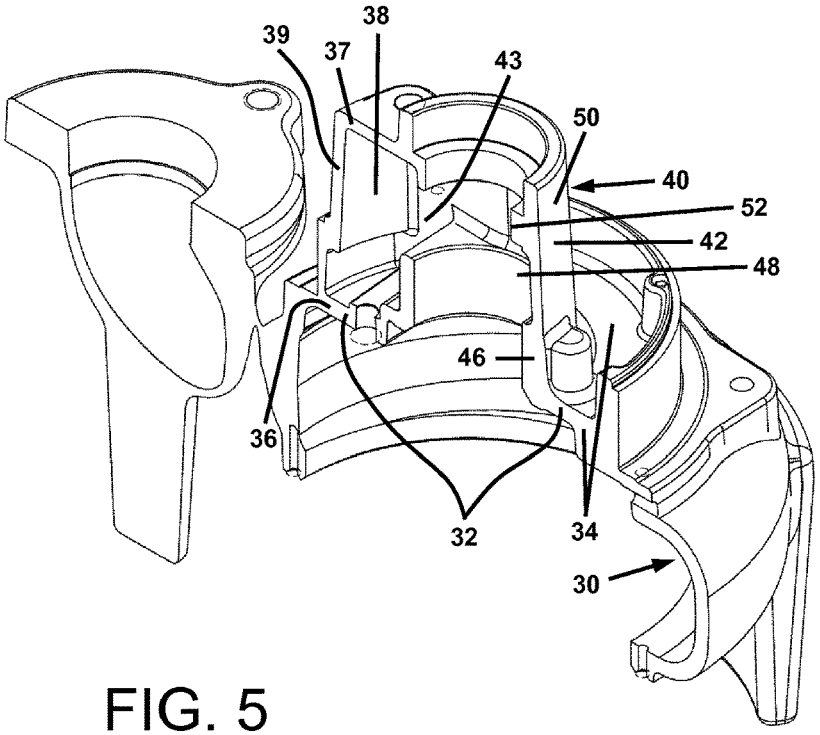
FIG. 5 is a perspective cross-sectional view of the volute and shaft sealing piece of FIG. 1, taken along the line 5-5 of FIG. 4.

Referring also to FIGS. 3A, 4, and 5, and in the embodiment depicted therein, the volute housing 30 is formed as a single piece housing comprised of an upper volute wall 32 comprised of a major portion 34 and a minor portion 36, a seal housing 40, and a lateral cavity 38. The seal housing 40 is comprised of a seal housing side wall 42 surrounding the distal portion 23 of the shaft 22 of the motor 20, thereby forming an annular central cavity 44 around the distal portion 23 of the shaft 22 of the motor 20. The seal housing 40 is further comprised of a lower end 46 joined to the upper volute wall 32 and comprising a lower bore 48, and an upper end 50 including an upper bore 52. The lateral cavity 38 is bounded by the minor portion 36 of the upper volute wall 32, an upper cavity wall 37, and a side cavity wall 39 joined to the seal housing side wall 42. The lateral cavity 38 is in fluid communication with the annular central cavity 44 through an opening 43 in the seal housing side wall 42.

The upper seal 60 is disposed in the upper bore 52, and is in sealing contact with the distal portion 23 of the motor shaft 22. The upper seal 60 may be retained in the upper bore 52 by an interference fit therewith, which also provides a sealed interface between the upper seal 60 and the upper bore 52. The upper seal 60 is also in fluid communication with the annular central cavity 44. In that manner, the upper seal 60 can be wetted and lubricated by a liquid lubricant that may be contained in the lateral cavity 38 and annular central cavity 44.

The lower seal 70 is disposed in the lower bore 48 and is in sealing contact with the distal portion 23 of the motor shaft 22. In certain embodiments, such as the embodiment depicted in FIG. 3A, a bushing 72 may be provided, which is disposed in the lower bore 48, in which case the lower seal 70 is disposed in an inner bore 74 of the bushing 72. In certain embodiments, the bushing may be fitted in lower bore 48 in a slip fit therewith. As used herein, the term "slip fit" is meant to indicate a fit between two parts such that the parts may be assembled by hand, i.e. not requiring the use of a press or other tools to provide sufficient force to overcome interference between the mating surfaces of the respective parts. Such a fit is also referred to in the art using terms including but not limited to transitional fit, snug fit, running fit, and free fit. In some embodiments, the slip fit may be a Locational Clearance fit of between LC4 and LC7, as specified in ANSI standard B4.1-1967, R1987. It is noted that under certain certifying entities, such as Underwriters Laboratories, Factory Mutual (of the FM Global mutual insurance company), and Canadian Standards Association International, which certify pumps as meeting safety and other industry standard, some clearance in seals and bushings is allowable based on the length of the labyrinth and internal volume. The slip fit as disclosed herein meets such standards. In certain embodiments, the bushing 72 may be formed integrally with the volute housing 30.

Such a configuration with bushing 72, whether provided separately as shown in FIG. 3A or integrally with volute housing 30, is advantageous when pumping flammable liquids. As per virtually all fire prevention and safety codes and regulations, such as those of the National Fire Protection Association (NFPA), e.g., the National Electrical Code (NEC), or NFPA 70, the pumping of flammable liquids requires that the pump must include provisions for explosion-proof and/or intrinsically safe operation.

Referring in particular to FIG. 3A, in the event that an ignition of a flammable liquid or vapors occurs within the motor housing 10, a rapid rise in pressure and temperature within the motor housing 10 would occur. According to fire prevention and safety codes, the pump 5 must be capable of containing such a pressure rise, or the pump 5 must be capable of venting the pressure rise in a controlled manner, while also not allowing the flame front within the motor housing 10 from propagating either outwardly and igniting materials external to the pump, or inwardly into the pump volute and igniting the flammable liquid being pumped.

By providing a bushing 72 as shown in FIG. 3A, relatively long pathways, i.e., "labyrinths" are provided at the interfaces of the volute housing 30.

In the embodiment depicted in FIG. 3A, in which the bushing 72 is provided separately from the volute housing 30, a first labyrinth is provided by the horizontal interface 71 and the vertical interface 73 that are formed between the bushing 72 and the volute housing 30. Because of the fit of the bushing 72 in the volute housing 30, at the normal operating pressures of the pump 10 (on the order of about several atmospheres, within the pump volute chamber 31), no liquid leaks occur through the interface 71 and 73 that form the first labyrinth. However, in the event of an ignition within the motor housing 10, which may produce pressures of about an order of magnitude higher, highly pressurized gas and/or liquid will be forced through the motor bearing 26 and upper seal 60. In such circumstances, the first labyrinth will function as a pressure-relieving interface, i.e., a pathway for pressure relief. Highly pressurized gas and/or liquid will leak through the first labyrinth to relieve the pressure, but the first labyrinth also functions as a flame arrestor. The flame front will not propagate through the labyrinth and into the volute chamber 31; thus ignition of any flammable liquid within the pump volute chamber 31 is prevented.

In addition to the first labyrinth as described above, in embodiments having a separate bushing 72 as shown in FIG. 3A, and embodiments (not shown) with an integral bushing, the pump 5 may be provided with a second labyrinth along the shaft 22 of the motor 20. Referring again to FIG. 3A, the second labyrinth may be provided by a second bushing 86 that is fitted into an upper cavity 85 in the first bushing 72. Thus in the event of an ignition within the motor housing 10 as described above, the second labyrinth that is formed between the inner bore 87 of the bushing 86 and the motor shaft 22, and/or the outer surface 89 of the bushing 86 and the upper cavity 85 of the first bushing 72, functions to relieve the high pressure while acting as a flame arrestor, preventing the flame front from propagating into the pump volute chamber 31. It will be apparent that as an alternative to providing the second bushing 86 that is fitted into the first bushing 72, the entire first and second bushing assembly may be provided as a single piece, so as to provide the first and second labyrinths as described above.

In certain embodiments, the pump 5 may be provided with a sensor 80 that is disposed in the lateral cavity 38. (Alternatively, the sensor 80 may be disposed in the annular cavity 44.) The sensor 80 may be configured to detect the presence or absence of the lubricant oil in the cavities, and/or the contamination of the lubricant oil therein with the fluid being pumped. Either condition would be indicative of a lower seal failure, in which case the sensor 80 would send a signal to a controller (not shown) of the pump to indicate a fault condition. In response to this indication, a human operator of the pump 5, or a software algorithm executed by a computer could halt the operation of the pump 5 before further damage occurs to the upper seal 60, and ultimately to the pump motor 20. The sensor 80 may be an optical sensor that senses an optical property of the liquid in the cavities, such as light transmittance; or an electrical sensor that senses an electrical property of the liquid such as conductance or capacitance; or a mechanical sensor that senses a mechanical property of the liquid such as viscosity. The sensor may also sense temperature. Advantageously, by using bushings 72 and/or 86 as shown in FIG. 3A, which provide labyrinths as described above, because the propagation of a flame past the bushings 72 and 86 are prevented in the event of an ignition of the fluid in the motor housing 10, the sensor 80 does not have to be an intrinsically safe sensor. This reduces the cost and complexity of the control wiring circuitry of the pump 5, and simplifies servicing the pump in the event that repair of maintenance is needed.

Referring again to FIG. 3A, it is noted that only the minor portion 36 of the upper volute wall 32 is used as a partial boundary of the lateral cavity 38, which contains a seal lubricant. This configuration leaves the major portion 34 of the upper volute wall 32 in direct fluid communication with the motor housing volume. Advantageously, this large surface of the major portion 34 of the upper volute wall 32 enables a high rate of heat transfer (by convection, conduction, and/or radiation) from the motor 10 to the fluid (not shown) contained in the volute 30 and being pumped. In that manner, the pump 5 is provided with dual seal capability that reduces the risk of motor damage due to a seal failure, while simultaneously having a high rate of heat transfer out of the pump motor housing 12, which reduces the risk of premature failure of the motor 10 caused by operating at a high temperature. In certain embodiments, the major portion 34 may be about 60 to 80 percent of the upper volute wall 32, with the remainder being the minor portion 36.

This is in marked contrast to current dual seal pumps having upper and lower seals, and an oil-filled cavity formed in a casting between the seals that extends a full 360 degrees around the motor shaft and thus reduces the rate of heat transfer from the pump motor axially through the upper pump volute wall and into the liquid being pumped. Such pumps are prone to premature failure due to operating at excessively high temperatures.

Referring again to FIGS. 4 and 5, in certain embodiments, the volute housing 30 and seal housing 40 may be formed by casting them as a single unitary part. By forming the volute housing 30 and seal housing 40 from a single piece of material, the planar surfaces, cylindrical cavities, and passageways thereof can be bored and/or milled on a single machine with great precision. Thus the problem of "tolerance stack up" that occurs when fitting together multiple volute pieces made on different machines is avoided. In certain embodiments, the motor housing 10 and volute housing 30 may be provided with respective mating flanges 15 and 35 to facilitate the joining of these parts to each other.

Figure 3B:
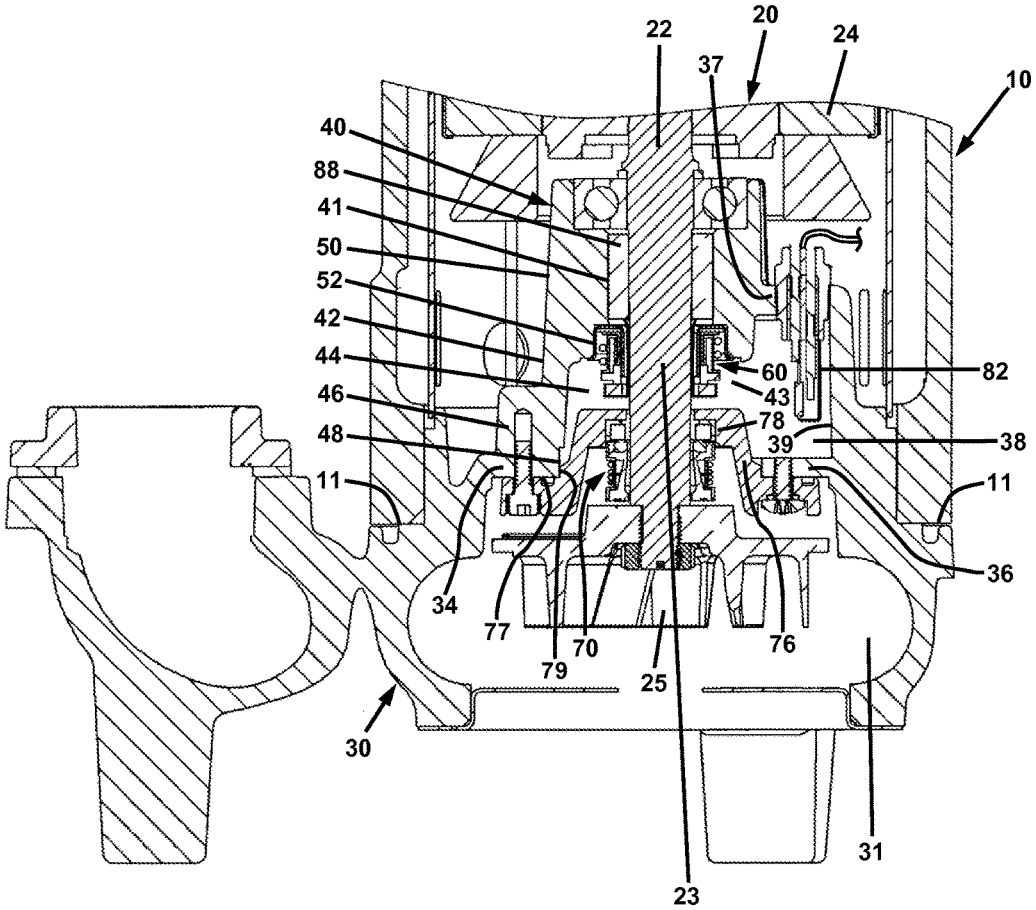
FIG. 3B is detailed side elevation cross-sectional view of the volute and lower motor region of a second embodiment of the pump.

Referring now to FIG. 3B, a detailed side elevation cross-sectional view of the volute and lower motor region an alternative embodiment of a pump is depicted. Certain features are similar to those described for the embodiment depicted in FIG. 3A. The volute housing 30 is comprised of an upper volute wall comprised of a major portion 34 and a minor portion 36, a seal housing 40, and a lateral cavity 38. The seal housing 40 is comprised of a seal housing side wall 42 surrounding the distal portion 23 of the shaft 22 of the motor 20, thereby forming an annular central cavity 44 around the distal portion 23 of the shaft 22 of the motor 20. The seal housing 40 is further comprised of a lower end 46 joined to the upper volute wall 32 and comprising a lower bore 48, and an upper end 50 including an upper bore 52. The lateral cavity 38 is bounded by the minor portion 36 of the upper volute wall 32, an upper cavity wall 37, and a side cavity wall 39 joined to the seal housing side wall 42. The lateral cavity 38 is in fluid communication with the annular central cavity 44 through an opening 43 in the seal housing side wall 42. The upper seal 60 is disposed in the upper bore 52, and is in sealing contact with the distal portion 23 of the motor shaft 22. The upper seal 60 may be retained in the upper bore 52 by an interference fit therewith, which also provides a sealed interface between the upper seal 60 and the upper bore 52. The upper seal 60 is also in fluid communication with the annular central cavity 44.

The lower seal 70 is disposed in the lower bore 48 and is in sealing contact with the distal portion 23 of the motor shaft 22. In certain embodiments, a bushing 76 may be provided, which is disposed in the lower bore 48, in which case the lower seal 70 is disposed in an inner bore 78 of the bushing 76. However, in contrast to the embodiment depicted in FIG. 3A, a relatively long pathway or "labyrinth" is not provided at the horizontal interface 77 and the vertical interface 79 of the bushing 76 and the volute housing 30.

Instead, in a manner similar to that of the embodiment of FIG. 3A, a labyrinth may be provided in the upper region of the seal housing 40 so as to provide a pressure relieving interface that passes high pressure liquid and/or vapor, but acts as a flame arrestor, preventing the propagation of a flame front from the motor housing 10 through the upper and lower seals 60 and 70 and into the pump volute chamber 31, in the event of an ignition in the motor housing 10. The labyrinth may be provided by fitting a bushing 88 into an upper cavity 41 in the upper region of the seal housing 40. It will be apparent that as an alternative to providing the bushing 88 that is fitted into seal housing 40, the entire bushing and seal housing assembly may be provided as a single piece, so as to provide the labyrinth as described above.

In order to provide further fire protection in this embodiment, the pump 5 may be provided with an intrinsically safe sensor 82 that is disposed in the lateral cavity 38 of the volute housing 30. (Alternatively, the sensor 82 may be disposed in the annular cavity 44.) The sensor 82 may be configured to detect the presence or absence of the lubricant oil in the cavities, and/or the contamination of the lubricant oil therein with the fluid being pumped, and the sensor 82 may detect a property of the lubricant oil, both as described previously for the embodiment of FIG. 3A.

Figure 6:
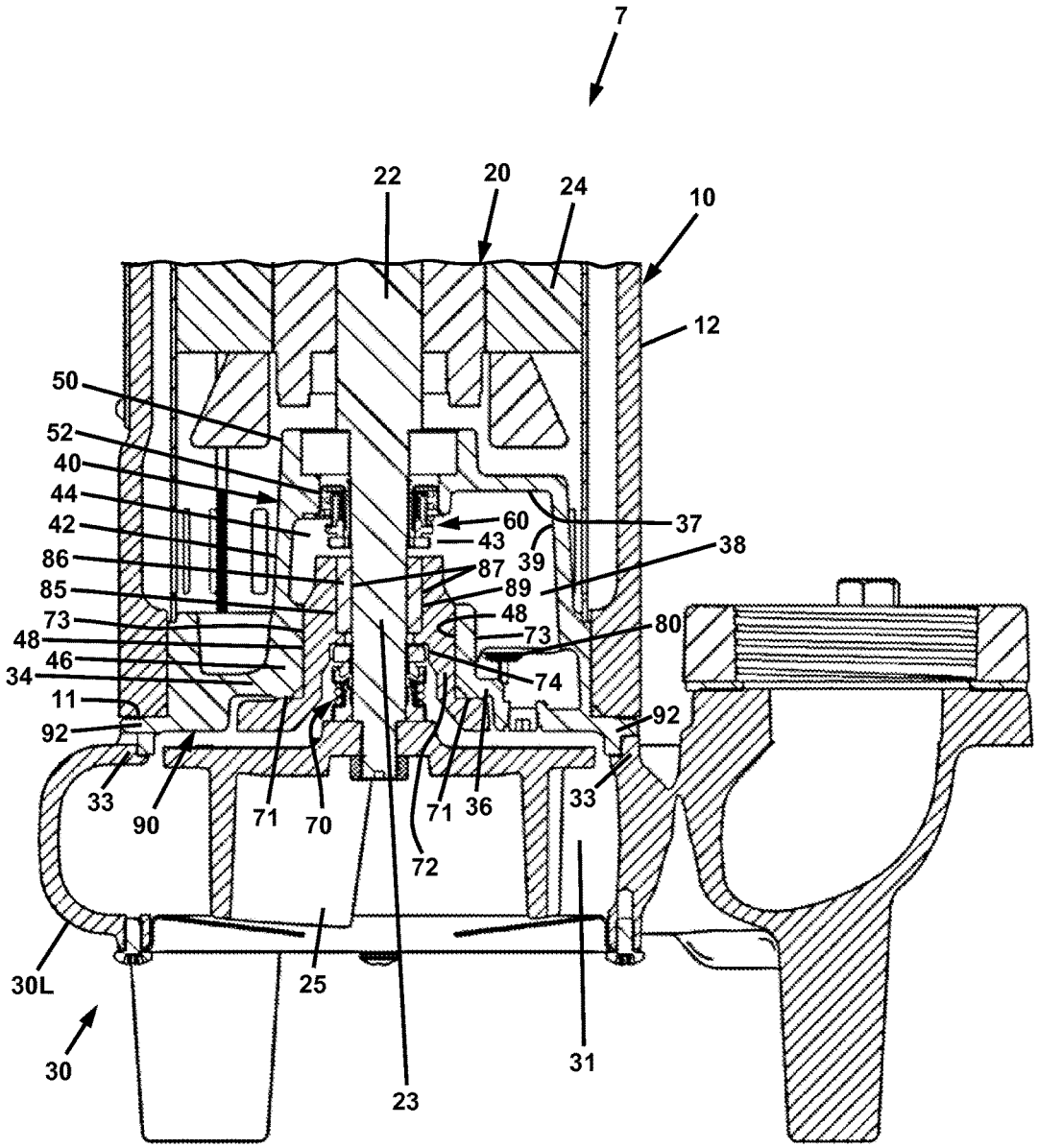
FIG. 6 is a detailed side elevation cross-sectional view of the volute and lower motor region of a third embodiment of the pump.

FIG. 6 depicts a side elevation cross-sectional view of the volute and lower motor region of a third embodiment of a pump of the present disclosure. Pump 7 of FIG. 6 differs from pump 5 of FIGS. 1 and 3A in that the upper volute wall is formed as a separate piece that is not unitary with the lower portion of the volute.

Like pump 5, pump 7 is comprised of a motor housing 10, a motor 20 contained within the motor housing 10, and a volute housing 30 joined to the distal end 11 of the motor housing 10. The motor 20 is comprised of a rotatable shaft 22 having a distal portion 23 extending beyond a motor stator 24 and into a volute cavity 31. An impeller 25 is joined to the end of the distal portion 23 of the rotatable shaft 22.

The volute cavity 31 is formed within the volute housing 30, which is comprised of a lower volute housing portion 30L and an upper volute wall 90. The upper volute wall 90 is joined to the distal end 11 of the side wall 12 of the motor housing 10 by suitable fasteners (not shown, but may be similar to the fasteners joining the volute housing 30 to the motor housing 20 of pump 5 in FIG. 1). The upper volute wall 90 forms the upper wall portion of the volute cavity 31. The volute 30 is joined to the upper volute wall 90 by suitable fasteners (not shown). The lower volute housing portion 30L may be comprised of a stepped flange 33, which is contiguous with a corresponding stepped flange 92 of the upper volute wall 90 when the lower volute housing portion 30L is joined to the upper volute wall 90. In that manner, the lower volute housing portion 30L and upper volute wall 90 are assembled together with high precision to form the volute housing 30. A gasket, O-ring, or other suitable seal (not shown) may be disposed between the mated stepped flanges 33 and 92 to prevent any leakage of liquid from the pump volute cavity 31.

The assembled lower volute housing portion 30L and upper volute wall 90 form substantially the same structure as the single piece volute housing 30 of pump 5 described previously herein with reference to FIGS. 1, 2, and 3A. As set forth for the upper volute wall 32 of the pump 5 shown in FIG. 3A, the upper volute wall 90 of pump 7 of FIG. 6 is comprised of a major portion 34 and a minor portion 36, a seal housing 40, and a lateral cavity 38. The seal housing 40 is comprised of a seal housing side wall 42 surrounding the distal portion 23 of the shaft 22 of the motor 20, thereby forming an annular central cavity 44 around the distal portion 23 of the shaft 22 of the motor 20. The seal housing 40 is further comprised of a lower end 46 joined to the upper volute wall 90 and comprising a lower bore 48, and an upper end 50 including an upper bore 52. The lateral cavity 38 is bounded by the minor portion 36 of the upper volute wall 90, an upper cavity wall 37, and a side cavity wall 39 joined to the seal housing side wall 42. The lateral cavity 38 is in fluid communication with the annular central cavity 44 through an opening 43 in the seal housing side wall 42.

The upper seal 60 is disposed in the upper bore 52, and is in sealing contact with the distal portion 23 of the motor shaft 22. The upper seal 60 may be retained in the upper bore 52 by an interference fit therewith, which also provides a sealed interface between the upper seal 60 and the upper bore 52. The upper seal 60 is also in fluid communication with the annular central cavity 44. In that manner, the upper seal 60 can be wetted and lubricated by a liquid lubricant that may be contained in the lateral cavity 38 and annular central cavity 44.

The lower seal 70 is disposed in the lower bore 48 and is in sealing contact with the distal portion 23 of the motor shaft 22. As for pump 5 of FIG. 3A, a bushing 72 may be provided, which is disposed in the lower bore 48, in which case the lower seal 70 is disposed in an inner bore 74 of the bushing 72. In certain embodiments, the bushing may be fitted in lower bore 48 in a slip fit therewith. In certain embodiments, the bushing 72 may be formed integrally with the upper volute wall 90.

As described previously, the assembled upper volute wall 90 and lower volute housing portion 30L form substantially the same structure as the single piece volute housing 30 of pump 5 of FIGS. 1, 2, and 3A. The bushings 72 and 86 provide the respective first and second labyrinths as described previously. Accordingly, the assembled components (numbered in the same manner as for FIG. 3A) provide the same function in fire and explosion protection described previously for pump 5 of FIG. 3A.

In like manner, the structure of the lateral cavity 38 of the upper volute wall 90 is as described for upper volute wall 32 of pump 5 of FIG. 3A. The minor portion 36 of the upper volute wall 90 is used as a partial boundary of the lateral cavity 38, with the major portion 34 of the upper volute wall 90 in direct fluid communication with the motor housing volume. This configuration enables a high rate of heat transfer from the motor 10 to the fluid (not shown) contained in the volute cavity 31 that is being pumped. Thus the pump 7 is also provided with dual seal capability that reduces the risk of motor damage due to a seal failure, while simultaneously having a high rate of heat transfer out of the pump motor housing 12, which reduces the risk of premature failure of the motor 10 caused by operating at a high temperature.

It is therefore apparent that there has been provided, in accordance with the present disclosure, a liquid pump comprising a sealing assembly that provides superior pump reliability, and that provides protection from the risk of fire or explosion when pumping flammable liquids. Having thus described the basic concept of the invention, it will be rather apparent to those skilled in the art that the foregoing detailed disclosure is intended to be presented by way of example only, and is not limiting. Various alterations, improvements, and modifications will occur to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be expressly stated in the claims.

I claim:

1. A pump comprising:

a) a motor housing enclosing a motor housing volume and comprising a motor housing side wall having a distal end;

b) a motor contained within the motor housing volume and comprising a rotatable shaft having a distal portion;

c) a volute housing joined to the distal end of the motor housing and comprising:

i) an upper volute wall comprised of a major portion and a minor portion;

ii) a seal housing portion comprising a seal housing side wall surrounding the distal portion of the shaft of the motor, and forming an annular central cavity around the distal portion of the shaft of the motor, and including a lower end joined to the upper volute wall and comprising a lower bore, and an upper end including an upper bore;

iii) a lateral cavity bounded by the minor portion of the upper volute wall, an upper cavity wall, and a side cavity wall joined to the seal housing side wall, the lateral cavity in fluid communication with the annular central cavity through an opening in the seal housing side wall;

d) an upper seal disposed in the upper bore, and in sealing contact with the distal portion of the motor shaft, and in fluid communication with the annular central cavity; and e) a lower seal disposed in the lower bore and in sealing contact with the distal portion of the motor shaft.

2. The pump of claim 1, wherein the major portion of the upper volute wall is in direct fluid communication with the motor housing volume.

3. The pump of claim 1, wherein the volute housing and seal housing are formed as a single unitary part.

4. The pump of claim 1, wherein the major portion of the upper volute wall is between 60 and 80 percent of the upper volute wall.

5. The pump of claim 1, further comprising a first bushing fitted in one of the lower bore and upper bore of the seal housing and comprising an outer surface contiguous with an inner surface of the one of lower bore and upper bore of the seal housing to form a first pressure-relieving interface therebetween.

6. The pump of claim 5, wherein the first bushing is fitted in the lower bore of the seal housing and comprises an inner bore, wherein the lower seal is fitted in the inner bore of the first bushing, and wherein the outer surface of the first bushing is contiguous with the lower bore of the seal housing to form the first pressure-relieving interface therebetween.

7. The pump of claim 6, wherein the first pressure-relieving interface is comprised of a horizontal interface formed between a horizontal surface of the first bushing in contact with a horizontal surface of the seal housing and a vertical interface formed between a vertical surface of the first bushing in contact with a vertical surface of the seal housing.

8. The pump of claim 7, wherein the vertical surface of the first bushing is in contact with the vertical surface of the seal housing in a slip fit.

9. The pump of claim 5, wherein the first pressure-relieving interface is a flame arrestor.

10. The pump of claim 5, wherein the first bushing is fitted in the lower bore of the seal housing and comprises an upper cavity surrounding a portion of the rotatable shaft of the motor and forming a second pressure-relieving interface.

11. The pump of claim 10, wherein the second pressure-relieving interface is formed by a second bushing fitted in the upper cavity of the first bushing.

12. The pump of claim 5, wherein the first bushing is fitted in an upper cavity of the upper bore of the seal housing and comprises an inner bore, and wherein an outer surface of the first bushing is contiguous with an inner surface of the seal housing to form the first pressure-relieving interface therebetween.

13. The pump of claim 1, further comprising a sensor in communication with at least one of the lateral cavity and the annular central cavity.

14. The pump of claim 13, wherein the sensor detects a property of a fluid contained in the lateral cavity and the annular central cavity.

15. The pump of claim 1, wherein the volute housing is further comprised of a lower volute housing portion joined to the upper volute wall.

16. The pump of claim 15, wherein the lower volute housing portion, the upper volute wall, and the seal housing are formed as a single unitary part.

* * * * *